US006776168B1

(12) United States Patent
Teufel et al.

(10) Patent No.: US 6,776,168 B1
(45) Date of Patent: Aug. 17, 2004

(54) DISINTEGRATABLE CIGARETTE FILTER

(75) Inventors: Eberhard Teufel, Gundelfingen (DE); Günter Maurer, Neuenburg (DE); Emmerich Sackers, Freiburg (DE)

(73) Assignee: Rhodia Acetow GmbH, Freiburg (DE)

( * ) Notice: Subject to any disclaimer, the term of this patent is extended or adjusted under 35 U.S.C. 154(b) by 0 days.

(21) Appl. No.: 10/110,953

(22) PCT Filed: Oct. 20, 2000

(86) PCT No.: PCT/EP00/10389

§ 371 (c)(1),
(2), (4) Date: Apr. 17, 2002

(87) PCT Pub. No.: WO01/28369

PCT Pub. Date: Apr. 26, 2001

(30) Foreign Application Priority Data

Oct. 22, 1999 (DE) ..... 199 51 062

(51) Int. Cl.[7] ..... A24D 3/06
(52) U.S. Cl. ..... 131/345; 131/343
(58) Field of Search ..... 493/39, 42, 47, 493/49, 50; 55/525, 528; 131/331, 332, 334, 340, 341, 342, 343, 345

(56) References Cited

U.S. PATENT DOCUMENTS

| | | | | | |
|---|---|---|---|---|---|
| 3,050,430 | A | * | 8/1962 | Gallagher | 156/166 |
| 3,224,453 | A | * | 12/1965 | Mahoney et al. | 131/341 |
| 3,552,400 | A | * | 1/1971 | Berger et al. | 131/339 |
| 3,675,541 | A | | 7/1972 | Tokitomo et al. | |
| 4,007,745 | A | | 2/1977 | Randall et al. | |
| 5,215,819 | A | * | 6/1993 | Anderheggen et al. | 428/364 |
| 5,427,852 | A | * | 6/1995 | Teufel et al. | 428/357 |
| 5,495,860 | A | * | 3/1996 | Teufel et al. | 131/331 |
| 5,568,819 | A | * | 10/1996 | Gentry et al. | 131/342 |
| 5,671,757 | A | * | 9/1997 | Woodings | 131/331 |
| 5,947,126 | A | * | 9/1999 | Wilson et al. | 131/331 |
| 6,145,511 | A | * | 11/2000 | Teufel et al. | 131/334 |
| 6,207,601 | B1 | * | 3/2001 | Maurer et al. | 442/333 |

FOREIGN PATENT DOCUMENTS

| | | |
|---|---|---|
| DE | 1632236 | 3/1972 |
| DE | 197 30 485 A1 | 1/1999 |
| EP | 0 745 336 A2 | 12/1996 |
| EP | 0 766 929 A2 | 4/1997 |
| EP | 0 880 907 A2 | 12/1998 |

* cited by examiner

*Primary Examiner*—Steven P. Griffin
*Assistant Examiner*—Carlos Lopez
(74) *Attorney, Agent, or Firm*—Fay, Sharpe, Fagan, Minnich & McKee, LLP

(57) ABSTRACT

The invention relates to a high performance cigarette filter on the basis of cellulose ester fibers or filaments which can be mechanically disintegrated. The inventive high-performance cigarette filter is characterized in that a) the fiber weight (or filament weight)/draw resistance ratio S based on the filament titer is greater than approximately 0.7, the S value being calculated according to the formula $S=(m_A/\Delta P_{7.8}/dpf[10\ m/daPA]$, wherein $m_A$ refers to the fiber weight, $\Delta P$ refers to the draw resistance and dpf represents the filament titer and for the draw resistance the value calculated for a diameter of 7.8 mm is inserted, b) the residual crimping value of the filter material does not exceed the value 1.45, c) the fiber weight amounts to maximally 10 mg/mm of the filter length, and d) the hardness of the cigarette filter is higher than approximately 90% filtrona hardness. The inventive filter is characterized by an improved disintegratability under environmental conditions vis-à-vis comparable products.

24 Claims, No Drawings

DISINTEGRATABLE CIGARETTE FILTER

The invention concerns a high-performance cigarette filter with mechanical disintegrability and based on cellulose ester fibres or filaments.

The majority of cigarette filters used currently is produced from filter tow, comprising endless, crimped in a crush chamber, cellulose-2,5-acetate filaments. For the production of the filter tow a solution of approx. 30% cellulose-2,5-acetate in acetone is pressed through spinning jets, the acetone is evaporated in a spinning shaft by blowing in heated air, a plurality of filaments (3.000 to 35.000) is combined into a band and subsequently this is crimped in a crush chamber. Afterwards the product is dried, filled into storage containers and finally compressed into bales having a weight of 300–600 kg. The total quantity of filter tow produced currently in the world according to this method is approx. 500.000 t/year, underlining the economic significance of the process. After transporting the filter tow bales to the filter manufacturer or cigarette manufacturer, the filter tow is removed from the bales and processed on a filter rod machine into filter rods, as it is described, for example, in U.S. Pat. No. 5,460,590. At the same time the filter is stretched in a stretching device, provided with an additive to bond the filaments and then, after forming a three-dimensional slub, is introduced into the forming part with the aid of a feed funnel, it is compressed there transversely to the axis, wrapped with paper and cut to the final length of the filter plug.

The additive used to bond the filaments is, as a rule, a solvent for the cellulose acetate with a high boiling temperature, like, for example, glycerol triacetate (triacetin), that, after its application, temporarily dissolves the surface of the filaments. Everywhere, where two filaments accidentally contact one another, after a while a firm adhesive position occurs, since the excess additive migrates into the surface of the fibres, due to which the previously liquid solvent drops, from the cellulose-2,5-acetate in the additive, solidifies. After a period of storage of less than one hour, depending on the previously mentioned migration of the hardening agent, mechanically firm, three-dimensionally interlaced filter plugs are obtained (called "space filter" in the following) with low packing density (nowadays usually 80–120 mg/cm$^3$), which due to their hardness can be processed at high speeds in modern cigarette machines.

The advantages of the entire process are the high efficiency of the filter tow production, the low transport costs from the filter tow manufacturer to the end users and, in particular, the high productivity of the filter production, which is determined not insignificantly by the lengths of the bands in the bales. The processing of filter tows is carried out on commercially available filter plug machines, like, for example, the KDF 3/AF 3 by Körber A G, Hamburg. In this conjunction production speeds of 600 m/min are the state-of-the-art. When using the double-strand technology described in DE-A-43 40 029 and when using the twin tow technology illustrated in DE-A-43 20 303, the productivity of the filter production can be even more markedly increased. A further advantage of the conventional filter production is based on the fact that by changing the speed ratios between the preparation and the formatting portions the filter properties regarding the reduction of pressure and consequently the filtration capacity can be varied within wide limits while retaining the specifications of the filter tow. Moreover, by varying the titre of the filament and the total titre an almost arbitrary amount of filters with different filtering capacities can be produced using the described method.

For the production of space filters nowadays mostly cellulose-2,5-acetate is used. With regard to the argument about smoking and health it has demonstrable underlining properties regarding the specific retention phenomena. Thus a filter from cellulose acetate filters nitrous amines and phenols having hazardous for health properties considerably more efficiently than condensate and nicotine. In addition, the taste of the smoke of the tobacco mixture used nowadays, as for example "American blend", "German blend" and "Virginia", in combination with a space filter from cellulose acetate is judged by the smoking person as the most pleasant one. Another advantage, not to be underestimated, of a space filter from cellulose-2,5-acetate is the visual homogeneity of the cut surfaces of the filter.

All other possible polymers, with which space filters can be produced by comparable methods, could not penetrate the market due to negatively affecting the taste of the smoke, lack of specific retention, problems with hardening and problems with cutting the filter on the filter rod machine, as well as on the cigarette machine. The very negative assessment of the smoking taste and the lack of specific retentions when using other polymers for the manufacture of space filters suggests that the advantages of today's acetate filters are not casually linked with the physical construction of the filter, but can be traced back to the adsorbing properties of the cellulose-2,5-acetate polymer, which should have positive effect in the case of surface filters also. However, despite their undisputable market domination, space filters from cellulose-2,5 acetate have some serious disadvantages: the draw resistance and filtration capacity are unambiguously defined based on the constructive physical specifications. The particle filtration as well as the condensate retention "$R_k$" of a conventional space filter is a function of filament titre (fibre density), filter diameter, draw resistance and length of filter. The following applies:

$$R_k = f(dpf, D, l, \Delta P) \quad (1)$$

where—dpf=filament titre [dtex]

D=diameter of filter [mm]

l=length of filter [mm], and

ΔP=draw resistance [daPA]

There was no shortage of experiments to illustrate the relationship between these values by empirically established equations. Examples of these can be found in the following publications: "Design of cigarettes", C. L. Brown, Hoechst-Celanese Corporation, 3$^{rd}$ edition, 1990 and Cable©: Capability Line Expert Copyright© 1994 by Rhodia Acetow A G, 79123 Freiburg, Germany.

In the currently used filter calculating program "Cable©" the following empirically determined relationship is used:

$$R_k = 100 \cdot (1 - D_k) \quad (2)$$

$$\text{where—} D_k = \exp(L \cdot A + B) \quad (3)$$

$$A = K1 - K2 \cdot dpf \quad (4)$$

$$L = 21 - l \quad (5), \text{ and}$$

$$B = -(K3 \cdot D^4 \cdot \Delta P + K4/dpf + K5) \quad (6).$$

K1 to K5 are constants, which have been determined in accordance with the tobacco mixture and the respective method to determine the retention. In other words: for a given filter length and a fixed diameter the filtration capacity of a cigarette filter is unambiguously determined by the draw resistance of the filter and the filament titre of the filter tow specification used.

There was no shortage of experiments to increase the filtration capacity of space filters while retaining specifications like length, diameter, draw resistance and filament titre. Such a high-performance filter is described, for example, in DE-A-26 58 479, wherein the increase of the filtration capacity is achieved by adding retention-increasing, finely dispersed metal oxides. The draw resistance ΔP of a space filter is also clearly defined. It depends from the diameter D of the filter, its length l, the filament titre dpf, the total titre G [g/10exp4·m] as well as the weight of the fibre $m_A$ [g]

$$\Delta P=f(D, l, dpf, G, m_A) \quad (7).$$

When using a defined filter tow specification, the fibre weight is unambiguously determined for a given filter plug having a draw resistance ΔP, a diameter D and a length l. The relationship between the fibre weight and draw resistance cannot be illustrated by a mathematical equation due to the diversity of the filter tow specifications available, the filter plug dimensions, the realisable different residual crimpings. However, the above mentioned Cable© allows the calculation of the fibre weight for a given draw resistance for each filter tow specification, residual crimping and filter plug dimension.

The fibre weight $m_A$ of a filter is defined by the residual crimping and the total titre using the following equation:

$$I_R=10000\cdot m_A/(G\cdot l) \quad (8).$$

The residual crimping is understood here as the ratio of the length of the crimped filament to the length of the filter. The residual crimping is a characteristic feature for a given cigarette filter. Based on the residual crimping values that are feasible by means of the state-of-the-art and the nowadays common filament titre for space filters made from cellulose esters, the total quantity of the space filter can be characterised by a ratio of the fibre weight to the draw resistance based on the filament titre. For the space filter the fibre weight/draw resistance ratio S based on the filament titre is unambiguously defined and this value never exceeds the value of 0.7 and consequently represents a characteristic value. This relationship can be expressed for space filters made from cellulose ester by:

$$S=(m_A/\Delta P_{7.8})/dpf<0.7[10\ \text{m/daPA}] \quad (9),$$

wherein for the draw resistance always a value converted for a diameter of 7.8 mm has to be used. For the conversion the following equation is to be used:

$$\Delta P_{7.8}=\Delta P_X\cdot(D_X/7.8)^{5.8}[\text{daPA}] \quad (10),$$

where the index X designates the diameter of the actual specimen.

Despite the immense diversity of possible space filters resulting from this due to the relationships (Equation 2) there are limitations regarding the achievable condensate retentions.

Technically it is not a problem at all to produce filters using the spectrum of the nowadays usual filter tow specifications to cover likewise the segment of full-flavour cigarettes, like medium and light cigarettes. It becomes a problem when a filtration capacity, like the one required for the construction of ultra-light cigarettes, when clearly more than 50% is required for a conventional filter diameter of 7.80 mm and a filter length of 21–25 mm. Since in the case of a space filter the smoke flows parallel to the direction of the fibres, this can be achieved only if the filament titre is considerably reduced what, with the simultaneous retention of the total titre, would result in the increase of the draw resistance. Therefore the total titre and the filament titre have to be reduced to the same extent, with the consequence that the hardness of the filter, in particular during smoking, is drastically reduced. This phenomenon is described by the person skilled in the art as "hot collapse" and is considered as totally undesirable.

Specific retention capacities, brought about by additives, can be realised only with a relatively high basis retention. Thus, for example, WO 97/16986 describes antimutantly acting additives, which act effectively only in conjunction with an equally high minimum nicotine retention. This requirement clearly limits the spectrum of the filter tow specifications that can be used in WO 97/16986 (cf. examples there in Table II, page 13).

A further undisputable disadvantage of space filters produced from cellulose acetate is their poor capability of mechanical disintegration in the environment. This poor ability to disintegrate disadvantageously delays the decomposition of the cigarette filter in the environment. It could be proved, that the decomposition of the cellulose acetate fibres can be effectively accelerated by the most diverse measures. All these measures act, however, equally in the direction of improvement of the biological decomposition of the cellulose acetate polymer, but not in the direction of easier disintegration of the filter. The effect of the measures described, for example, in DE-C-43 22 966 and DE-C-43 22 965 is basically limited by the three-dimensional interlacement of the filaments in a space filter. Therefore the microorganisms necessary for the decomposition of the filter material outdoors have a limited access to the filaments and consequently to the biological decomposition of the polymer. The undoubtedly improved ability to biologically decompose the polymer is therefore overdefined or dominated by the poor mechanical disintegration of the space filter.

Since in the case of the earlier mentioned crimping in a crush chamber one deals with a three-dimensional crimping, in the case of the slub formed during the production of the filter even without hardening additive, but also, as suggested in DE-C-43 22 966, when using water soluble adhesives, a three-dimensional interlacing of the filaments takes place in the completed filter, what is so significant that the mechanical disintegration of the filter in the environment is markedly hindered in these cases also. Similar limitations apply to the photomechanical decomposition of filaments. The acceleration described in EP-A-0 716 117 and EP-B-0 732 432 is limited by the described constructive disadvantages of a space filter.

Therefore EP-A-0 880 907 proposes to prevent cross-hooking in the completed filter as far as possible by using filter tow specifications with extremely low residual crimping (see page 5, equation 8). In the end this is achieved by a dramatic increase of the total titre and consequently of the weight of the filter. This will naturally result in an increase of the draw resistance. Therefore to compensate for these high draw resistances the filament titre has to be correspondingly increased (see Example II).

EP-A-0 880 907 describes as further measures a partial cutting up of the filter after its production and the use of water soluble adhesives. For the sake of completeness it should be mentioned that the cigarette filter capable to disintegrate and described in EP-A-0 880 907 satisfies the criteria of the space filter with regard to the weight/draw resistance ratio S<0.7 based on the filament titre (Example II:S=0.31 m/daPA).

A completely different method for the production of aerosol filters uses as basic material a flat shaped article like, for example, paper, spun mat, textile fabric or non-woven material (such filters will be described in the following as "surface filters"). These filters avoid the above mentioned limitations regarding filter capacity and ability to disintegrate. In this conjunction the manufacturer of the filter material produces a flat shaped article, it is rolled on bobbins and subsequently despatched to the processor. The filter or cigarette manufacturer unwinds the material off the bobbins, shapes it into a rod-like product, compacts it in the forming part of the filter rod machine transversely to the axis, wraps it with paper and cuts it to the final length of the filter plug. In addition, as a rule, but not necessarily, the flat shaped product is crimped in a crimping device before forming it into rods parallel to the direction of travel. This will reduce the-material density on the one hand and influence the pressure drop (draw resistance) of the filter on the other. However, the packing density of 120–300 mg of fibre/$cm^3$ of the surface filters known today is markedly above that of the known space filter made from cellulose acetate. A transverse interlacing of the fabric layers, as a rule, does not take place and is intentionally not attempted.

The best known surface filter is made from paper and is marketed, for example, by Filtrona, Hamburg, under the commercial name of Myria Filter. WO 95/14398 describes a filter made from paper from artificial, highly fibrillated cellulose fibres of lyocell fibres, mixed with cellulose fibres or also with acetate fibres. Furthermore, WO 95/35043 concerns a cigarette filter made from a water-punched fabric, that again contains the lyocell fibres as a component.

Of course, in addition to the applications mentioned, all other known methods to form flat shaped articles in conjunction with lyocell fibres, which are of the greatest interest due to the diameter of their fibres after fibrillation, can be used for the production of surface filters.

All these filters are considered as biologically easily decomposing, because they can easily disintegrate due to the lack of interlacing of the flat layers and the low resistance to water of the products produced in a paper making process. After unrolling the cigarette filter to a flat shaped article under environmental influences, such a flat shaped article presents, in contrast to a poorly disintegrating space filter, a relatively greater surface for the microorganisms suitable for the biological decomposition. A further essential advantage of the surface filter is a markedly higher nicotine and condensate retention while having draw resistances corresponding to those of space filters. This higher filtration capacity can be explained with the physical construction of surface filters and, accordingly, does not depend on the filter material used.

Nevertheless, when using surface filters, wherein the filter material is not made at all or only partly from cellulose acetate, the negative influence of the taste of the smoke by, for example, cellulose fibres, is negatively judged time and time by the users. In addition, the filters made mainly from cellulose fibres, do not have the high selective retentions relative to phenolen and nitrous amines that are so typical for the space filter made from cellulose acetate.

Therefore there was no shortage in experiments in the past to propose surface filters on cellulose acetate base. Thus DE-A-27 44 796 describes the use of so called fibrets made from cellulose acetate in combination with cellulose acetate or natural or synthetic fibres for the production of surface filters. U.S. Pat. No. 3,509,009 describes, for example, the application of the melt-blown technique for the production of fabrics to be used in cigarette filters.

DE-C-196 09 143 claims, inter alia, a melt-blown fabric for the production of cigarette filters, starting with a thermoplastic cellulose acetate. All cigarette filters produced from the materials described have the advantage that the filtration capacity (measured as nicotine or tar retention) of these filters is markedly higher than the draw resistance of comparable space filters made from cellulose acetate. It is further known, that pure cellulose acetate is not suitable to be processed in processes using thermal deformation of polymer. The problems arising in this conjunction are described in detail in DE-C-196 09 143.

Another disadvantage is that due to the higher density of the filters mentioned above, the material usage is relatively so high, that even when using cheaper initial material, like paper based on paper wood pulp, the price per filter is not very different from that of a space filter made from cellulose acetate. The filters would be considerably more expensive if flat shaped articles from spun endless fibres are used for their manufacture. In these cases at the commencement of the spinning process a crimped tow is available for the production, that is cut to a fibre, which in turn in an additional operation is further processed to a flat shaped article as initial material for the filter manufacturer. Examples of such a procedures are described in the already mentioned WO 95/14398 or also in DE-A-27 44 796.

In view of the above described disadvantages it would be understood that the technology of surface filters, produced by the multi-stage method (spinning, cutting, production of fabric) has never caught up for the processing of mass-produced articles (full-flavour or light-segment).

A clearly different method to manufacture surface filters from cellulose acetate is described in DE-A-1 930 435. In this case a conventional filter tow, manufactured from non-thermoplasticised cellulose acetate fibres, is unwound from a bale, expanded in a conventional preparation part, stretched and provided with a usual plasticiser. Then, in deviation from the usual processing method to manufacture space filters, the prepared filter tow web is heated up in a heating device and subsequently thermoplastically interlaced under pressure with the aid of profiled, heated rollers. The two-dimensional reinforced flat shaped article produced in this manner is then collated, compressed transversely to the axis, wrapped around with paper and cut. As it is described in U.S. Pat. No. 4,007,745, this will result in a surface filter from endless cellulose ester filaments. An advantage of this method is that it is the first time that from the point of view of the product properties of the filter the advantages of the surface filter with regard to nicotine and condensate retention are combined with the advantages of the cellulose acetate polymer with regard to specific retention and taste. The single-stage, cost-effective transformation of the filter tow into a surface filter is also an advantage. However, the filter is characterised by a plurality of triangular smoke channels, which are formed from a fabric that has a large number of rectangular depressions. A further disadvantage of this filter construction is that the triangular channels become well visible, especially during smoking, presenting a visual disadvantage of the manufactured product.

The method illustrated in DE-A-1 930 435 as well as the corresponding cigarette filter of the U.S. Pat. No. 4,007,745 have some further considerable disadvantages: caused by the thermoplastic melting of the filaments large-area, completely molten surface portions with low porosity (see FIGS. 2–6) occur, which are ineffective to filter of the smoke. Consequently the amount of material required for these filters is considerably greater than that of today's space filters. As an example, filters are described in U.S. Pat. No. 4,007,745 the material usage of which exceeds two to two and a half times those required today (see Examples 4–7).

Furthermore, the crimping in the non-reinforced flat portions have three-dimensional orientation (see DE-A-1 930 435, FIG. 6), with the consequence that during the compression transversely to the axis to form the filter plug the adjacent flat layers again interlace partly three-dimensionally. This is strengthened by the fact that due to the short thermal treatment of the filter tow web before the thermoplastic interlacing of the fabric, the plasticiser applied prior to plasticisation has not yet migrated into the fibres and consequently contributes to the adhesion of adjacent fabric layers similarly to the hardening of the space filters made from cellulose acetate. It is to be noted on this occasion that in the case of the products used for the plasticisation of the cellulose acetate, described in DE-A-1 930 435, one deals with the same chemical substances as the ones used for the hardening of space filters made from cellulose acetate functioning as solvents.

Both last mentioned disadvantages prevent the unrolling of the surface filter into a fabric web. The relevant principles correspond to those of the space filter discussed above.

A further disadvantage of the teaching of DE-A-1 930 435 is based on the fact that, as already mentioned, at the time of the fabric formation the filter tow web is moistened with hardener, due to which the surface will become very sticky. This leads to adhesion on the calender rollers and consequently makes the management of the method, in particular at processing speeds of >100 m/min, very difficult.

Accordingly, the object of the invention is to provide surface filters based on endless cellulose ester fibres, which do not have the above mentioned disadvantages of the state-of-the-art, particularly of the filter described in U.S. Pat. No. 4,007,745. These should have an adequate hardness without three-dimensional interlacing, while their mechanical disintegrability should correspond to those of surface filters manufactured from fabric with short-cut fibres. On this occasion the filtrona hardness should satisfy the market requirements. Furthermore, the surface filter should retain the advantageous or, in some cases improved, properties known from the state-of-the-art.

According to the invention this objective is achieved by a high-performance cigarette filter with mechanical disintegrability based on cellulose ester, in particular cellulose acetate, fibres or filaments, characterised in that a) the fibre weight/draw resistance ratio S based on the filament titre is greater than approx. 0.7, wherein the S value is calculated according to the formula:

$$S=(m_A/\Delta P_{7.8})/dpf[10\ \text{m/daPA}]$$

where $m_A$=fibre weight [g], ΔP=draw resistance [daPA], and dpf=filament titre [dtex] and for the draw resistance the value converted for a diameter of 7.8 mm is used, b) the residual crimping of the filter material does not exceed the value of 1.45, c) the fibre weight is maximum 10 mg/mm of filter length, and d) the hardness of the cigarette filter exceeds approx. 90% of the filtrona hardness.

To manufacture a filter according to the invention either a thermoplastic cellulose ester fibre or filament material or, in the case of a non-thermoplastic cellulose ester, a water-soluble adhesive is used. When in the following a fibre material is discussed, then the corresponding explanation, provided it is appropriate, also applies to filament materials. (Regarding the thermoplastic properties of the cellulose ester derivatives reference is made to the discussion represented in DE-A-196 09 143 concerning internal and external plasticisers (page 1, line 65 et seq.). The conclusions therein are of fundamental significance for the understanding of the following explanations. For the definition of thermoplasts additional reference is made to "Römpps Chemielexikon, 8$^{th}$ revised and expanded edition, Vol.6, Franckh'sche Verlagsbuchhandlung, Stuttgart 1988, page 4229"). For the first case of a thermoplastic cellulose ester fibre material two cases can be distinguished. In the first case the fibre material is produced from a cellulose ester that is already naturally thermoplastic, like, for example, cellulose acetate butyrate. In this case the filter tow can be processed into a filter according to the invention without any further measure. In the case of an initially non-thermoplastic polymer, like, for example, cellulose-2,5-acetate, it has to be thermoplasticised by adding a suitable plasticiser. In this case the plasticiser has to be homogeneously distributed in the fibres. The homogeneous distribution of the plasticiser in the fibres can be checked by various methods. These are, for example: recording of the evaporation kinetics of the plasticiser. For this purpose a filter plug is heated in an inert gas flow and the evaporation kinetics is tested by incinerating in a commercially available flame-ionisation detector (FID). The evaporation kinetics of a plasticiser evenly introduced in the fibre strongly differs from a plasticiser applied to the surface. Since the evaporation is carried out in a diffusion controlled manner, in the case of uniform distribution the evaporation kinetics is significantly slower than in the case of surface application. Another possibility is to illustrate the evaporation kinetics is by means of differential-thermogravimetrics. Thirdly, the uniform distribution can be determined by short-time extraction method in solvents suitable for the polymer with the subsequent quantitative analysis of the plasticiser. For a homogeneously distributed plasticiser this method results in a markedly lower analysed value for the plasticiser applied only to the surface while having the same percentage content. A further possibility to quantitatively differentiate between surface and uniformly distributed plasticisers is to investigate it by means of NIR reflection. For the homogeneously distributed plasticiser this method results in a clearly lower analysis value than for the plasticiser applied only to the surface while having the same percentage content.

To produce the filter according to the invention a filter tow is unwound from the bales, pneumatically expanded and stretched using the methods conventional for the space filter. Before the actual step of producing the filter, intermediately a non-woven fabric with an as low as possible strength in the direction of both surface axes is produced. In a surprising manner this was successful especially when the plasticiser necessary for the thermoplasticisation is uniformly distributed in the fibres.

Within the scope of the invention the fibre weight/draw resistance ratio S based on the filament titre according to the formula referred to above is greater than approx. 0.7. If it falls below this value, it leads to retention values like those common for conventional cellulose acetate filters. Preferably the fibre weight/draw resistance ratio S based on the filament titre is maximum 2, and in particular it is in the range of approx. 0.8–1.3. If the preferred value of approx. 2 for the ratio S is exceeded, then this product does no longer satisfies the desired economic requirements.

With regard to the further basic parameters the following framework requirements apply:

The residual crimping $I_R$ of the filter material is below 1.45. The residual crimping is preferably between approx. 1.05–1.4, in particular between approx. 1.1–1.3.

Within the scope of the teaching according to the invention the fibre weight can be max. 10 mg/mm of filter length, in particular max. 9.0 mg/mm of filter length, and preferably at least 4 mg/mm of filter length. The preferred range is between approx. 5–8 mg/mm of filter length. If the maximum value of 10 mg/mm is exceeded, then such a product is economically not viable. Preferably a minimum value of approx. 5 mg/mm of filter length is adhered to. If it falls below this value, the hardness of the cigarette filter of a minimum of 90% according to the state-of-the-art no longer can be adhered to. The minimum limit value of the filtrona hardness of approx. 90% is orientated towards market requirements. The filtrona hardness of the cigarette filter according to the invention can be in this case set to approx. 90–95%, in particular approx. 91–93%. (Determination of filtrona hardness: a cylindrical rod of 12 mm diameter presses vertically with its flat face with a load of 300 g a horizontally positioned filter rod. The ratio of the compressed diameter to the initial diameter determined prior to the first contact results in the filtrona hardness indicated as a percentage). It is of a particular advantage when a high-performance filter according to the invention according to the CBDTF test after a 10-week test period has a weight loss of at least 40%, in particular at least approx. 50% by weight.

The draw resistance of the filter according to the invention is preferably in a range of between 1–12 daPA/mm of filter length. The filament titre of the filter tow qualities used varies between 1–20 dtex.

The disintegrability of the cigarette filter according to the invention is increased by a light residual crimping $I_R$. This light residual crimping reduces the cross-hooking of the filaments within and between the planes of the fabric webs. As discussed above, the residual crimping of the filter according to the invention is below 1.45.

For a further improvement of the mechanical disintegrability of the filter according to the invention it would be advisable to produce it from a fibre strip having a multiple width, in accordance with the teaching of DE 43 40 029. According to a further embodiment the cigarette filter can be produced from a fibre strip that was separated into several strips before entering into the strand portion of the filter rod machine.

The endless thermoplastic cellulose ester fibres of the invention may contain cellulose acetate, in particular cellulose-2,5-acetate, cellulose butyrate, cellulose acetate butyrate, cellulose acetopropionate and/or cellulose propionate. In an advantageous manner the endless thermoplastic fibres from cellulose acetate have a degree of substitution of approx. 1.5–3.0, preferably approx. 2.2–2.6.

The cellulose ester used for the thermoplastification and the plasticiser uniformly distributed in the fibres could be selected, for example, from the following groups: glycerine ester (in particular glycerine triacetate), ethylene carbonate and propylene carbonate, citric acid ester (in particular acetyl citrate, triethyl citrate), glycol ester (in particular triethylene glycol diacetate (TEGDA) or diethylene glycol dibenzoate), Carbowax® (in particular polyethylene glycols with a molecular weight of 200–14000, as manufactured by the UCC company, USA), Sulfolan (tetrahydrothiopene-1, 1-dioxide), fatty acid ester, phosphoric ester (in particular trioctyl phosphate, triphenyl phosphate or trimethyl phosphate), esters of phthalic acid (in particular dimethyl phthalate, diethyl phthalate, dibutyl phthalate, and/or diisodecyl phthalate) and mixtures of any compounds from one or several of these substances.

The expert in this technical field is familiar with the amount of plasticising plasticisers and/or water soluble adhesives to be introduced. Generally speaking the quantity of plasticiser and/or adhesive is approx. 1–40% by weight, in special cases the content of the plasticiser can exceed this range without any problem without affecting the teaching of the invention.

As water soluble adhesive, which are preferably present on the surface of the fibres, the usual high-boiling solvents applied during the manufacture of space filters from cellulose acetate, like polyalkylene oxides (like polyethylene glycols, polypropylene glycols or copolymers from polyethylene oxide and polypropylene oxides as well as their derivatives), water soluble ester or ether (also cellulose ester or cellulose ether), starches, starch derivatives, p-polyvinyl alcohols (partially or completely hydrolysed, as well as their derivatives), polyvinyl ether (and its derivatives), p-polyvinyl acetates and/or polysaccharides, water soluble polyamides and polyacrylates can be used, i.e. applied to the fibre web.

In a further preferred embodiment of the invention the cellulose ester fibres and filaments contain additives in the form of photoreactive additives, additives promoting the biological disintegrability, additives with selective retention action and/or dye pigments. As photoreactive additive a finely dispersed titanium oxide of the anatase type with an average particle size smaller than 2 $\mu$m is preferably used. As additives, promoting the biological decomposition, the following are to be named in particular: nitrogen-containing substances, the natural or microbial decomposition products of which release basic amines (e.g. urea and its derivatives; oligopeptides and proteins, like β-lactoglobulin; condensation products from carbonyls and amines, for example hexamethylene tetramine; as well as nitrogen-containing organic heterocyclene, in particular carbazoles).

Preferred additives with selective retention effect are filtration aids, like those mentioned, for example, in WO 97/16986. Preferably organic acids or acidic carboxylic acid ester, polyphenols or porphyrin derivatives are used. With regard to the biological and photo-chemical decomposing ability the high-performance cigarette filter according to the invention can be improved by suitable measures to an extent what in the case of space filters of the state-of-the-art can be done only to a limited extent.

Accordingly, the advantages connected with the invention are manifold. In particular the easy disintegrability of the filter according to the invention under environmental influences is of great advantage. Compared to a known space filter this can be markedly improved with regard to the biological and photo-chemical decomposition. In addition, when compared with space filters made, for example, from cellulose acetate, it has an increased retention while having the same draw resistance, while simultaneously the requirements placed on the filter, in particular by the cigarette manufacturer and the end user, are satisfied to a great extent. Moreover, by mixing different initial tows of any filament size (filament titre) it is possible to set a corresponding optimum surface volume and filtration capacity. This modus operandi makes it also possible to optimise the filter in accordance with its filtrona hardness. Furthermore, by virtue of the plasticiser used, like for example triacetin, a positive influencing of the taste can be carried out, while, however, simultaneously a considerably smaller amount of the plasticiser passes directly into the smoke. Consequently significantly lower condensate values have been established in the case of the high-performance cigarette filter according to the invention.

The invention is described in detail in the following based on examples which, however, should not limit the teaching according to the invention. Within the scope of the disclosure according to the invention, further embodiments become obvious to the person skilled in the art.

EXAMPLES

Comparison Example 1

As comparison example 1, which represents a nowadays common cigarette filter (space filter), a cigarette filter is produced from a filter tow according to the 3.0 Y 35 specification. This filter comprises individual filaments of the filament titre 3.33 dtex and a total titre of 38.889 dtex while Y is the cross-section of the filament. The filters have a length of 21 mm and a diameter of 7.80 mm. The triacetin content is 7% (=8.5 mg). The draw resistance is 60 daPA at an acetane content weight of 107 mg. The filters are wrapped with a non-porous filter-wrapping paper manufactured by Glatz (67468 Neidenfels, Germany) having the designation of F 796–28. The filtrona hardness of the filter rods is 92.2%. Accordingly the filter has a weight/draw resistance ratio S=0.54 (10 m/daPA), standardised for the filament titre. These filters were tested for their disintegration in accordance with the test method, developed by a CORESTA working group (CBDTF test). The results are summarised in Table 1.

The test material (10 filter plugs, with paper removed) is irradiated with a Xenon-burner with wave lengths greater than 290 nm. The irradiation intensity is determined at 340 nm and set to 0.35 $Wm^{-2}nm^{-1}$. The temperature, measured by a white standard, is 55° C. The specimens are moistened twice daily with deionised water. Once a day the specimens are mechanically stressed by vibrating with four steel balls (M=16 g, D=1.2 cm) in a steel cup. After conditioning the specimens, once a week the weight and alternatively the volume is determined. To determine the condensate retention of the filter, the 21 mm long filters are coupled to an "American Blend" tobacco strand and smoked in accordance with the CORESTA recommendations Nos.22 and 23. The Cambridge filter and the filter separated from the tobacco stub are extracted in methanol and after corresponding dilution the extinction of the solutions is determined by a UV spectroscope at a wave length of 310 nm. The retention is calculated according to the following equation:

$$R_k = E_{Filter}/(E_{Filter} + E_{Cambridge\ filter}).$$

In the Comparison example 1 the condensate retention was determined at 37.5%.

Comparison Example 2

A filter tow according to the 3.0 Y 55 (Filament titre: 3.33 dtex; total titre: 61.111 dtex) specification was prepared on a conventional two-stage stretching machine KDF 2 manufactured by Hauni, Hamburg, and sprayed with 8% triacetin. After leaving the reversing rollers the filter tow web with a minimum width of 250 mm is introduced to a pair of heated calender rollers and calendered with an effective line pressure of 40 kg/cm. The profiled calender rollers have a diameter of 230 mm and a fluted width of 350 mm and have 10 profiled flutes per cm. They are heated with a silicon oil to a temperature of 205±3° C. The profile of the flute has a trapezium shape with a top width of 0.4 mm and a depth of 0,45 mm and an included angle of 35°.

After leaving the calender rollers the fabric produced in this manner is folded in a strand shape by introducing it into a spinning jet and a commercially available KDF 2 manufactured by Körber, Hamburg, with a strand velocity of 70 m/min, wrapped around by paper and cut to filter rod lengths of 126 mm. The diameter of the filter rods was set to 7.8 mm. The filtrona hardness of the filter rods was 89.5%. From these filter rods filter plugs with a length of 21 mm were cut, which then, as illustrated in the Comparison example 1, were checked for their disintegrability (The results are summarised in Table 1). The draw resistance of these filter rods is 51 daPA at an acetane content weight of 141 mg. Thus the fibre weight/draw resistance ratio is S=0.83 [10 m/daPA] based on the filament titre. The condensate retention, determined as described in Comparison example 1, was 42.3%.

The proof of the non-homogeneous distribution of the sprayed-on triacetin is carried out as follows: a 21 mm long filter plug produced three months prior to the date of investigation is introduced into a V2A steel pipe with an inside diameter of 7.5 mm. The inside diameter of the steel pipe is tapered to a diameter of 0.3 mm on both ends by technical means. On the entry side nitrogen gas flows in at a flow rate of 30 mL/min and on the exit side it is connected to a commercially available flame ionisation detector (FID). The test pipe is heated in a heating furnace at a heating rate of 75° C./min up to a furnace temperature of 150° C. The recorded FID signal reaches its maximum intensity latest after two minutes and the basis line after approx. 6 min.

Example 300 kg cellulose acetate flakes is filled into a double-walled universal mixer having a total volume of 615 L and a cooling/heating device. The mixing tool 1 is integrally mounted with three vanes rotating in the vicinity of the bottom and placed vertically on the drive shaft. Horizontally to the drive shaft a single-piece four-vaned chopper tool 2 is mounted, that prevents the formation of agglomerate while the plasticiser is added and diffused and is driven at a circumferential speed of 21 m/sec (2890 rpm).

The mixer 1 is started up with a circumferential speed of 6.5 m/sec. For 10 min 65 kg triacetin is evenly added. At this time the chopper tool 2 is switched on. A further intensive mixing is carried out for 12 min to produce an intimate mixture. In the next 20 min it was heated up to a material temperature of 76° C. This temperature was held for 5 min. Subsequently it was cooled continuously for 30 min to 20° C. The total period of action of the triacetin on the flakes was 67 min. Following this the mixer was quickly emptied within three minutes. This product, obtained in accordance with this method, has good trickling and storage capacities. The thermoplasticised cellulose acetate granules are processed by means of conventional dry-spinning method to a filter tow with the specification of 3.0 Y 55 [filament titre 3.33 dtex; total titre 61.111 dtex].

This filter tow was prepared on a conventional two-stage stretching machine KDF 2 manufactured by Hauni, Hamburg. In contrast to Comparison example 2, no additional plasticiser has been added after stretching. After leaving the reversing rollers the filter tow web with a minimum width of 250 mm is introduced to a pair of heated calender rollers and calendered. The profiled calender rollers have a diameter of 150 mm and a width of 550 mm and have 10 profiled flutes/cm. They are heated with a silicon oil to a temperature of 180±3° C. The profile of the flute has a trapezium shape with a top width of 0.4 mm and a depth of 0.45 mm and an included angle of 35°. After leaving the calender rollers the fabric produced in this manner is folded in a strand shape and wrapped around by paper in a commercially available KDF 2 manufactured by Körber, Hamburg, with a strand velocity of 120 m/min, and cut to filter rod lengths of 126 mm. The diameter of the filter rods was set to 7.8 mm. The filtrona hardness of the filter rods was 91.4%.

From these filter rods filter plugs with a length of 21 mm were cut, which then, as illustrated in the Comparison example 1, were tested for their disintegrability (The results are summarised in Table 1). The draw resistance of these filter rods is 51 daPA at a fibre content weight of 156 mg. Thus the fibre weight/draw resistance ratio is S=0.92 [10 m/daPA] based on the filament titre. The condensate retention, determined as described in Comparison example 1, was 44.1%.

The proof of the homogeneous distribution of the sprayed-on triacetin is carried out as follows: a 21 mm long filter plug produced three months prior to the date of investigation is introduced into a V2A steel pipe with an inside diameter of 7.5 mm. The inside diameter of the steel pipe is tapered to a diameter of 0.3 mm on both ends by technical means. On the entry side nitrogen gas flows in at a flow rate of 30 mL/min and on the exit side it is connected to a commercially available flame ionisation detector (FID). The test pipe is heated in a heating furnace at a heating rate of 75° C./min to a furnace temperature of 150° C. The recorded FID signal reaches its maximum intensity at the earliest after four minutes and the basis line after approx. 10 min.

In Table 1 the results of the disintegration experiments of Comparison examples 1, 2 and of the example according to the invention are illustrated.

TABLE 1

| Duration of experiment in weeks | Comparison example 1 Residual weight [%] | Comparison example 2 Residual weight [%] | Example Residual weight [%] |
|---|---|---|---|
| 1 | 93 | 95 | 87 |
| 2 | 92 | 94 | 85 |
| 3 | 92 | 94 | 82 |
| 4 | 91 | 94 | 75 |
| 5 | 88 | 93 | 69 |
| 6 | 86 | 93 | 62 |
| 7 | 81 | 92 | 47 |
| 8 | 78 | 91 | 34 |
| 9 | 76 | 90 | 28 |
| 10 | 72 | 89 | 21 |

From the above tabulated values it becomes apparent that as the duration of experiment progresses the disintegration of a product produced according to the invention is surprisingly markedly superior to the values of the comparison examples.

In Table 2 all measured data are summarised.

TABLE 2

| | Dpf [dtex] | G [dtex] | $I_R$ | Draw resistance [daPA] | Fibre weight [mg] | Diameter [mm] | S [10 m/daPa] | Hardness [%] |
|---|---|---|---|---|---|---|---|---|
| Comparison example 1 | 3.33 | 38.889 | 1.31 | 60 | 107 | 7.8 | 0.54 | 92.2 |
| Comparison example 2 | 3.33 | 61.111 | 1.09 | 51 | 141 | 7.8 | 0.83 | 89.5 |
| Example | 3.33 | 61.111 | 1.22 | 51 | 156 | 7.8 | 0.92 | 91.4 |

What is claimed is:

1. A high-performance cigarette filter with mechanical disintegrability and comprising cellulose ester fibres or filaments, characterised in that a) the fibre weight (or filament weight)/draw resistance ratio S based on the filament titre is greater than approx. 0.7, wherein the S value is calculated according to the formula:

$$S=(m_A/\Delta P_{7.8})/dpf[10\ \text{m/daPA}]$$

where $m_A$=fibre weight [mg], ΔP=draw resistance [daPA], and dpf=filament titre [dtex] and for the draw resistance the value converted for a diameter of 7.8 mm is used, b) the residual crimping of the filter material does not exceed the value of 1.45, wherein the residual crimping is calculated by $$I_R=10000\cdot m_A/(G\cdot l)$$

c) the fibre weight is maximum 10 mg/mm of filter length, d) the hardness of the cigarette filter exceeds approx. 90% of the filtrona hardness, and e) the cigarette filter according to the CBDTF test after a 10-week test period has a weight loss of at least 40%.

2. A high-performance cigarette filter according to claim 1, characterised in that the cellulose ester is cellulose acetate.

3. A high-performance cigarette filter according to claim 1, having a plasticiser uniformly distributed in the fibres or filaments.

4. A high-performance cigarette filter according to claim 1, characterised in that a water-soluble adhesive is present on the surface of the fibres or filaments.

5. A high-performance cigarette filter according to claim 1, characterised in that the residual crimping is between approx. 1.05–1.4.

6. A high-performance cigarette filter according to claim 1, characterised in that the cigarette filter is produced from a fibre strip having a multiple width.

7. A high-performance cigarette filter according to claim 1, characterised in that the cigarette filter is produced from a fibre strip that was before separated into several strips.

8. A high-performance cigarette filter according to claim 1, characterised in that the fibres or filaments comprise cellulose-2,5-acetate, cellulose butyrate, cellulose acetate butyrate, cellulose acetopropionate and/or cellulose propionate.

9. A high-performance cigarette filter according to claim 1, characterised in that the cellulose ester fibres or filaments have a plasticiser content between 1–40%.

10. A high-performance cigarette filter according to claim 1, characterised in that the cellulose ester fibres or filaments have a plasticiser selected from the group consisting of triacetin, triethylene glycol diacetate and citric acid diethylester.

11. A high-performance cigarette filter according to claim 1, characterised in that the fibres or filaments are based on cellulose acetate with a degree of substitution of approx. 1.5–3.0.

12. A high-performance cigarette filter according to claim 4, characterised in that the water soluble adhesive are on the form of polyethylene glycols, water soluble ester or ether, starches and/or starch derivatives, p-polyvinyl alcohols, p-polyvinyl acetates.

13. A high-performance cigarette filter according to claim 1, characterised in that the fibre weight (or filament weight)/draw resistance ratio S based on the filament titre is maximum 2.

14. A high-performance cigarette filter according to claim 1, characterised in that the fibre weight (or filament weight) is at least 4 mg/mm of filter length.

15. A high-performance cigarette filter according to claim 1, characterised in that the filtrona hardness of the cigarette filter is approx. 90–95%.

16. A high-performance cigarette filter according to claim 1, characterised in that the cigarette filter has a weight loss of at least approx. 50% by weight according to the CBDTF test.

17. A high-performance cigarette filter according to claim 1, characterised in that the cellulose ester fibres or filaments contain additives in the form of photoreactive additives, additives promoting the biological disintegrability, additives with selective retention action and/or dye pigments.

18. A high-performance cigarette filter according to claim 17, characterised in that the photoreactive additive is a finely dispersed titanium oxide of the anatase type with an average particle size smaller than 2 $\mu$m.

19. A high-performance cigarette filter according to claim 17, characterised in that organic acids or acidic carboxylic acid ester, polyphenols and/or porphyrin derivatives are used as additives.

20. A high-performance cigarette filter according to claim 1, characterised in that the residual crimping is between approx. 1.1–1.3.

21. A high-performance cigarette filter according to claim 1, characterised in that the fibres or filaments are based on cellulose acetate with a degree of substitution of approx. 2.2–2.6.

22. A high-performance cigarette filter according to claim 1, characterised in that the fibre weight (or filament weight)/draw resistance ratio S based on the filament titre is approx. 08.1.3.

23. A high-performance cigarette filter according to claim 1, characterised in that the fibre weight (or filament weight) is about 5–8 mg/mm of filter length.

24. A high-performance cigarette filter according to claim 1, characterised in that a filtrona hardness of the cigarette filter is approx. 91–93%.

* * * * *